US005993245A

United States Patent [19]

Osada

[11] Patent Number: 5,993,245

[45] Date of Patent: Nov. 30, 1999

[54] TERMINAL STRUCTURE

[75] Inventor: Yutaka Osada, Hachioji, Japan

[73] Assignee: Osada Co., Ltd., Tokyo, Japan

[21] Appl. No.: 08/884,054

[22] Filed: Jun. 27, 1997

[30] Foreign Application Priority Data

Sep. 6, 1996 [JP] Japan ..... 8-257619

[51] Int. Cl.[6] ..... H01R 4/24

[52] U.S. Cl. ..... 439/441; 439/819

[58] Field of Search ..... 439/441, 819, 439/822, 729

[56] References Cited

U.S. PATENT DOCUMENTS 4,243,285 1/1981 Crowley et al. ..... 439/822

*Primary Examiner*—Paula Bradley
*Assistant Examiner*—Katrina Davis
*Attorney, Agent, or Firm*—Finnegan, Henderson, Farabow, Garrett & Dunner, L.L.P.

[57] ABSTRACT

A terminal structure is disclosed, wherein a metal plate is turnable at one end thereof with respect to a metal terminal, and a torsion coil spring 23 has one end normally pressing the metal plate so that the metal plate may be turned away from the metal terminal when the terminal structure is operated to insert an electrically conductive wire thereinto and so that the metal plate may be turned towards the metal terminal when a force is applied to the electrically conductive wire to pull out the same from the terminal structure, thereby to press the electrically conductive wire against the metal terminal with a stronger force of the torsion coil spring, thus securing the electric conduction between the metal terminal and the electrically conductive wire while allowing the electrically conductive wire to be connected and disconnected to and from the terminal structure with a light operating action.

3 Claims, 9 Drawing Sheets

TERMINAL STRUCTURE

BACKGROUND OF THE INVENTION

1. Field of the Invention

The present invention relates to a terminal structure, and, more particularly, relates to a specific terminal structure, wherein a metal plate is turned away from a metal terminal against the spring action of a torsion coil spring while an electrically conductive wire is inserted. If the action is applied to the electrically conductive wire to be pulled out from the structure, the metal plate is turned towards the metal terminal thereby to press the electrically conductive wire against the metal terminal with a stronger force and secure the electric conduction between the metal terminal and the wire. The torsion coil spring of a specific elasticity normally gives such pressure as to hold the electrically conductive wire and the metal terminal in an electrically stabilized conductive condition. Further the electrically conductive wire may be attached and detached with one-touch light operating action.

2. Description of the Related Art

To date, various terminal structures have been proposed wherein an electrically conductive wire may be easily connected to the structure with one-touch operating action. For example, the terminal structure 1 shown in FIG. 15 is composed of an electrically isolated case 2 of synthetic resin. The terminal structure has a metal terminal 3 secured to and within the case 2 by a pair of extensions 3*a* being protruded out of the case. A metal plate 4, that is, a substantially U-shaped plate spring, has a center portion 4*a* mounted on a pin 2*a* formed on the case 2, has one end 4*b* engaging an inner surface 2*b*, and has the opposite end 4*c* pressed against the metal terminal 3. Further, an operating pin 5 is slidably inserted into a guide hole 2*c* formed within the case 2.

If the operating pin 5 is pressed from the outside of the case 2, the inner end 5*a* of the operating pin 5 presses the end 4*c* of the metal plate 4 against the spring action thereof in the direction away from the terminal 3. Thus the electrically conductive wire (not shown) may be inserted into between the metal terminal 3 and the metal plate 4 through a wire guide hole 2*d* formed within the case 2. Upon freeing the operating pin 5, the metal plate 4 returns with its elasticity to press the electrically conductive wire against the metal plate 3, thereby to secure the electric conduction between the electrically conductive wire and the metal plate 3.

However, according to the conventional terminal structure 1 having the plate spring 4 used to apply pressure to the electrically conductive wire, the user is required to press such a small operating pin 5 against the strong spring action of the plate spring in order to insert the electrically conductive wire into the structure 1 or to pull out the same therefrom. Therefore the operation of the operating pin 5 will cause pain to the finger of the user and the operability is extremely bad. As the result, the user often fails to press the operating pin 5 deep enough allowing the electrically conductive wire to be forcibly pulled out of the case with the resultant damages given to the terminal structure 1.

Another conventional terminal structure 10, as shown in FIG. 16, is composed of an electrically isolated case 11 of synthetic resin. The terminal structure has a U-shaped metal terminal 12 secured to and within the case 11 by a pair of extensions protruded out of the case. A metal plate 13 has one end formed in a ring 13*a* and has an opposite flat end 13*b*. The metal plate 13 is, at the ring 13*a*, turnably mounted on a support pin 11*a* formed on the case 11 so that the metal plate 13 may be turnable with respect to the metal terminal 12. A compression coil spring 14 is provided between the case 11 and the metal plate 13 so that the compression coil spring 14 may press the flat end 13*b* of the metal plate 13 against the metal terminal 12. Further an operating pin 15 is slidably inserted into a guide hole 11*b* formed within the case 11.

According to the conventional terminal structure 10, especially having the compression coil spring 14 used in such a way that one end of the compression coil spring 14 is simply pressed against the metal plate 13, the end of the compression coil spring 14 is actually liable to slide with respect to the metal plate 13. It therefore often happens that the position where the compression coil spring 14 applies the pressure to the metal plate 13 will change each time the operating pin 15 is pressingly operated. As the result, it becomes difficult to hold the electrically conductive wire with a constantly stabilized pressure.

SUMMARY OF THE INVENTION

The invention has been provided to eliminate the defects and disadvantages of the prior art as mentioned above. It is therefore a primary object of the invention to provide a unique terminal structure substantially comprising a metal plate having one end turnably mounted on the case so that the metal plate may be turnable with respect to a metal terminal and a torsion coil spring having one end normally pressing the metal plate in the direction of the metal terminal so that the metal plate may press an electrically conductive wire against the metal terminal, thereby to establish the electric conduction between the metal terminal and the electrically conductive wire, wherein the metal plate maybe turned away from the metal terminal with a considerably light operating action and the electrically conductive wire may be easily and securely connected to the metal terminal, and further the terminal structure may be prevented from the damages which may otherwise be caused by abnormal pull of the wire from the terminal structure.

It is another object of the invention to provide the terminal structure wherein the metal terminal has a support formed thereon for turnably supporting the metal plate thereon and also for supporting the torsion coil spring thereon together with the metal plate so that the torsion coil spring may normally press the metal plate against the metal terminal, thereby to considerably reduce the size of the terminal structure, and to enable the user to very easily and lightly operate the terminal structure to connect and disconnect the electrically conductive wire to and from the terminal structure, which is therefore reliable mechanically as well as operationally, and wherein a plurality of such terminal structures are arranged side by side within a case of synthetic resin.

It is still another object of the invention to provide the terminal structure wherein the metal plate has one end turnably mounted on a support pin formed on a case of synthetic resin, and the torsion coil spring has the coil portion mounted on another support pin formed on the case while one end of the torsion coil spring is in engagement with the recess of the metal plate so that the metal plate may be operated with a light operating action and the repeated operations will not deteriorate the constant spring force of the torsion coil spring to be applied to the electrically conductive wire.

In short, the present invention relates to a terminal structure for detachably holding an electrically conductive wire for electrical conduction therewith, and is characterized by combination of a case, a metal terminal provided in the case, a metal plate provided in the case and having one end turnably mounted on the case so that the metal plate may be turnable with respect to the metal terminal, and a torsion coil spring having a coil portion turnably mounted on the case and having one end thereof engaging the metal plate and having the opposite end engaging the case. The torsion spring normally applies a pressure to the metal plate so that the metal plate may press the electrically conductive wire against the metal terminal to establish the electric conduction between the electrically conductive wire and the metal terminal, the torsion coil spring allowing the metal plate to be turned away from the metal terminal against the spring action of the torsion spring when the electrically conductive wire is inserted into the case, the torsion coil spring turning the metal plate towards the metal terminal when a force is applied to the electrically conductive wire to pull the same outwardly of the case, thereby to increase the pressure for holding the electrically conductive wire between the metal plate and the metal terminal.

BRIEF DESCRIPTION OF THE DRAWINGS

FIGS. 1 through 9 show a first embodiment of the invention, wherein:

FIG. 1 is a perspective view of a terminal structure;

FIG. 2 is an exploded perspective view of the terminal structure;

FIG. 3 is a plan elevational view of the terminal structure shown in lateral section;

FIG. 4 is a front elevational view of the terminal structure;

FIG. 5 is a perspective view of the terminal structure partly broken to show the essential part thereof;

FIG. 6 is a perspective view of three pieces of terminal structures arranged side by side within a case shown partly broken;

FIG. 7 is a front elevational view of the terminal structure shown in vertical section to show an electrically conductive wire being inserted into the terminal structure;

FIG. 8 is a front elevational view of the terminal structure shown in vertical section to show the electrically conductive wire which is pressed against a metal terminal by a metal plate and is made electrically conductive with the metal terminal;

FIG. 9 is a front elevational view of the terminal structure shown in vertical section to show the electrically conductive wire which is pulled out of the case;

FIGS. 10 through 14 show a second embodiment of the invention, wherein:

FIG. 10 is a perspective view of a terminal structure broke to show the essential part thereof;

FIG. 11 is a front elevational view of the terminal structure shown in vertical section;

FIG. 12 is a front elevational view of the terminal structure shown in vertical section to show an electrically conductor wire inserted into the terminal structure;

FIG. 13 is a front elevational view of the terminal structure shown in vertical section to show the electrically conductor wire inserted deep into the terminal structure while a metal plate is turned away from a metal terminal;

FIG. 14 is a front elevational view of the terminal structure shown in vertical section to show the electrically conductive wire pressed against the metal terminal by the metal plate and made electrically conductive with the metal terminal;

FIGS. 15 and 16 show the conventional terminal structures, wherein:

FIG. 15 is a front elevational view of a terminal structure shown in vertical section to show a metal plate formed as a plate spring; and FIG. 16 is a front elevational view of another terminal structure shown in vertical section to show a metal plate pressed by a compression coil spring.

DETAILED DESCRIPTION OF THE PREFERRED EMBODIMENTS

Figure 1:
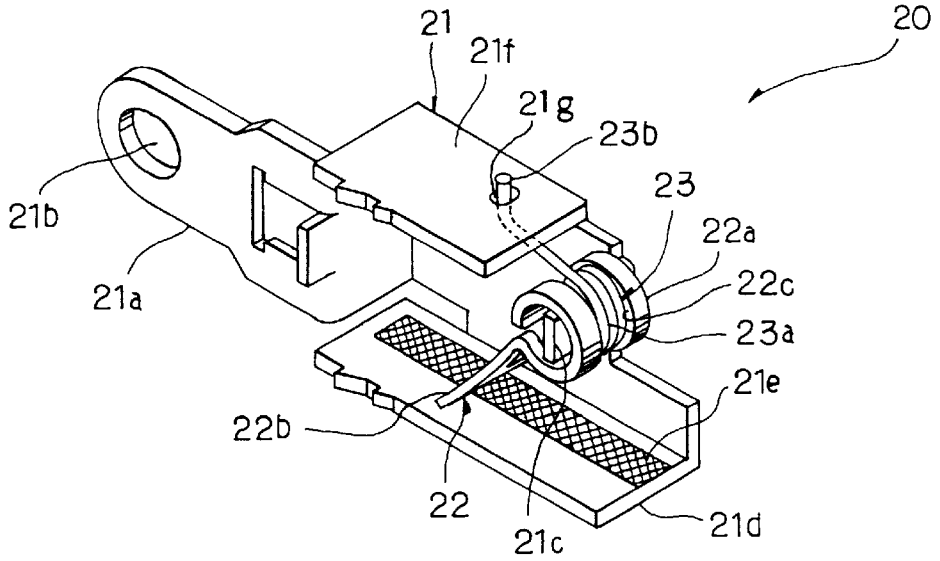
Figure 2:
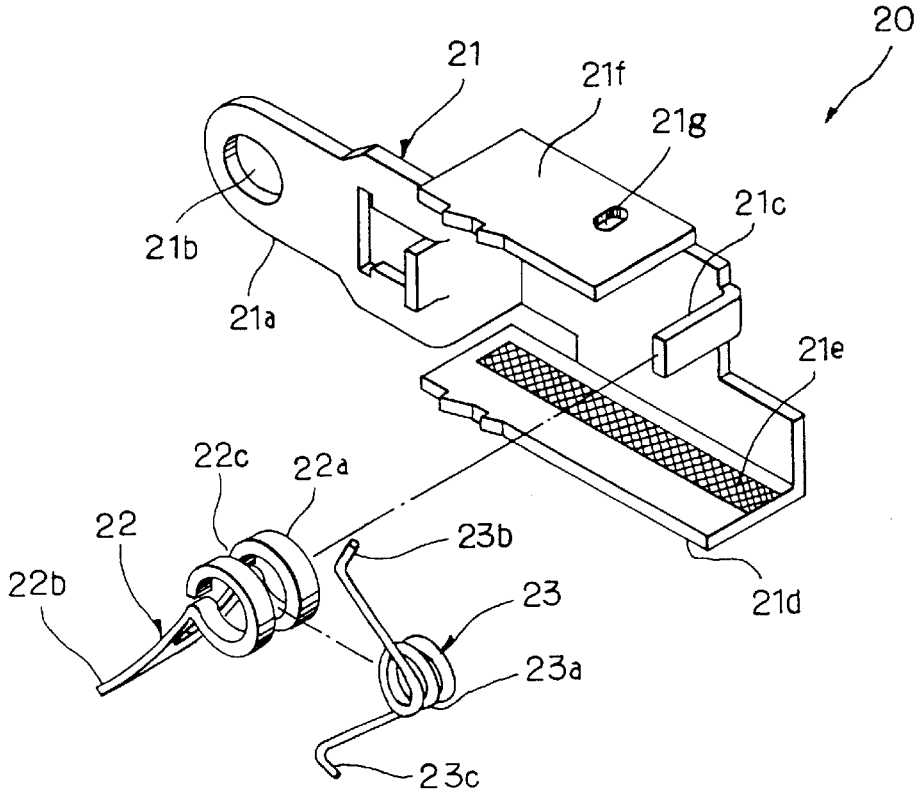
Figure 3:
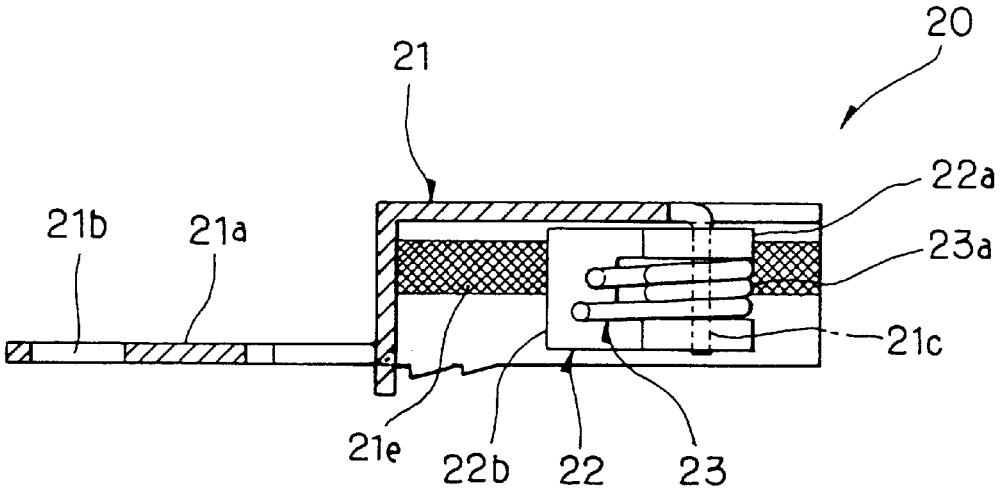
Figure 4:
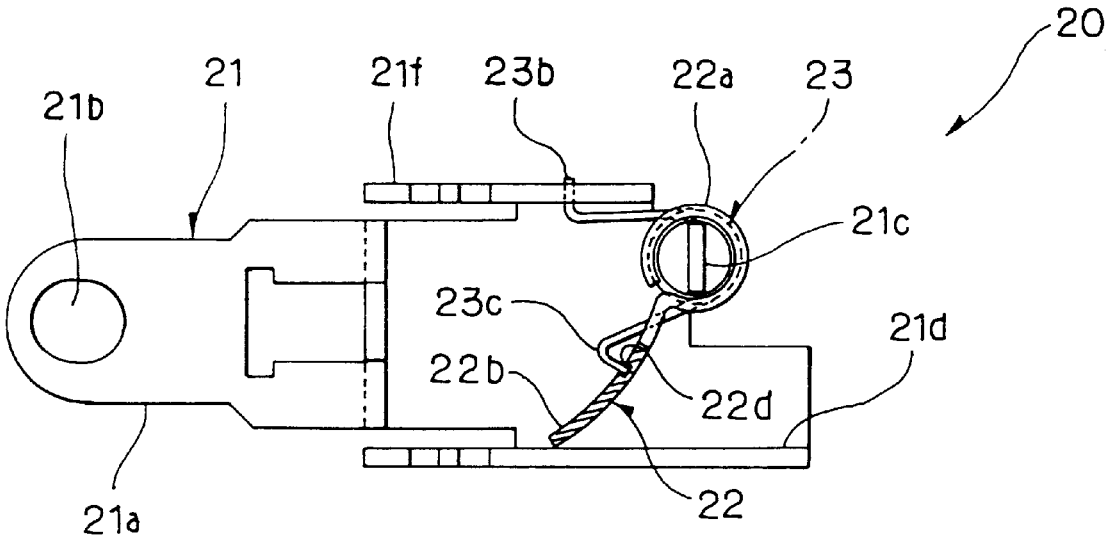
Figure 5:
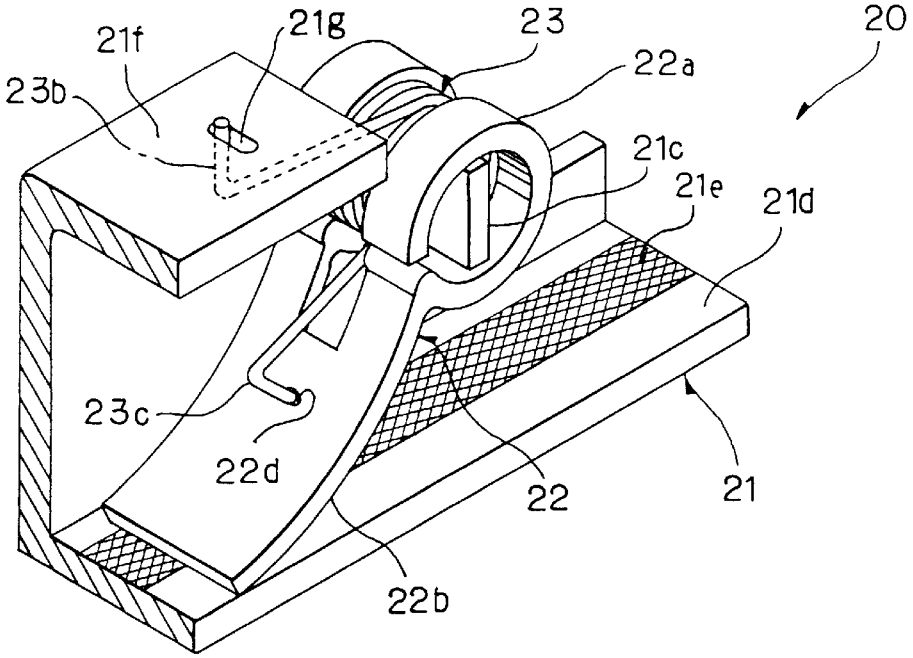

The invention will now be described in reference to the preferred embodiments as shown in the attached drawing. In FIGS. 1 through 6, a terminal structure 20 of the first embodiment according to the invention is substantially composed of a metal terminal 21, a metal plate 22 and a torsion coil spring 23.

The metal terminal 21 is provided to take out the electric conduction through the terminal structure 20, and is formed with a plate of metal such as iron plated with an electrically favorable conductive material. The plate is, as shown, bent into a sidewise U-shape having opposite sidewalls 21*d*, 21*f*. The metal terminal 21 has an extension 21*a* provided on one side lengthwise of the side walls and having an opening 21*b* formed at the end thereof so that an electrically conductive wire (not shown) may be inserted therethrough and soldering the to the end. Further the metal terminal 21 has another extension of a reduced width provided opposite to the extension 21*a* and bent at right angle in the same direction with the side walls 21*d*, 21*f* so as to form a support pin 21*c*.

The side wall 21*d* has an upper side providing a contact surface 21*e*, which is roughly processed with the knurling process so as to securely hold an electrically conductive wire 24 pressed thereagainst. The other side wall 21*f* has an opening 21*g* through which one end of the torsion coil spring 23 is inserted.

The metal plate 22 is provided to press the electrically conductive wire 24 against the contact surface 21*e* of the metal terminal 21. The metal plate 22 has one end formed with rings 22*a* forked with a space 22*c* provided therebetween and has a slightly curved flat part extended from the forked rings 22*a* and forming a pressing part 22*b*. The flat part has a hole 22*d* formed thereon, into which the other end of the torsion coil spring 23 is inserted.

The space 22*c* between the rings 22*a* is provided to accommodate therein a coil portion 23*a* of the torsion coil spring 23.

The torsion coil spring 23 is provided to apply pressure to the metal plate 22. The opposite ends 23*b*, 23*c* of the spring are inserted into the opening 21*g* of the metal terminal 21 and into the hole 22*d* of the metal plate 22, respectively.

With the coil portion 23*a* of the torsion coil spring 23 being inserted into the space 22*c* between the rings 22*a* of the metal plate 22 while the rings 22*a* and the coil portion 23*a* are supported on the support pin 21*c*, the opposite ends 23*b*, 23*c* are inserted into the opening 21*g* and the hole 22*d* respectively.

Figure 6:
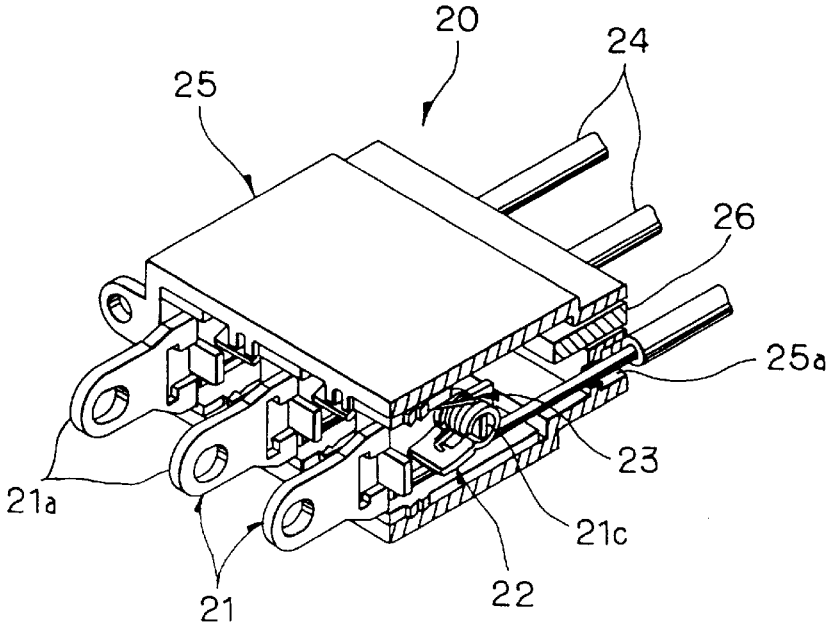

In reference to FIG. 6, a plurality of terminal structures 20, each of which is constructed as mentioned above, are contained in a case 25 of a material such as the synthetic resin and the like which is electrically isolated. The case 25 has an operating pin 26 slidably provided therein. The pin 26 may be pressed from the outside to apply pressure to the pressing part 22*b* of the metal plate 22 thereby to turn the metal plate 22 in the direction 2 where the metal plate 22 is spaced from the metal terminal 21.

The embodiment as shown in FIG. 6 shows three terminal structures 20 arranged side by side in the case 25 so that three electrically conductive wires 24 may be connected to the terminal structures 20, respectively.

Figure 10:
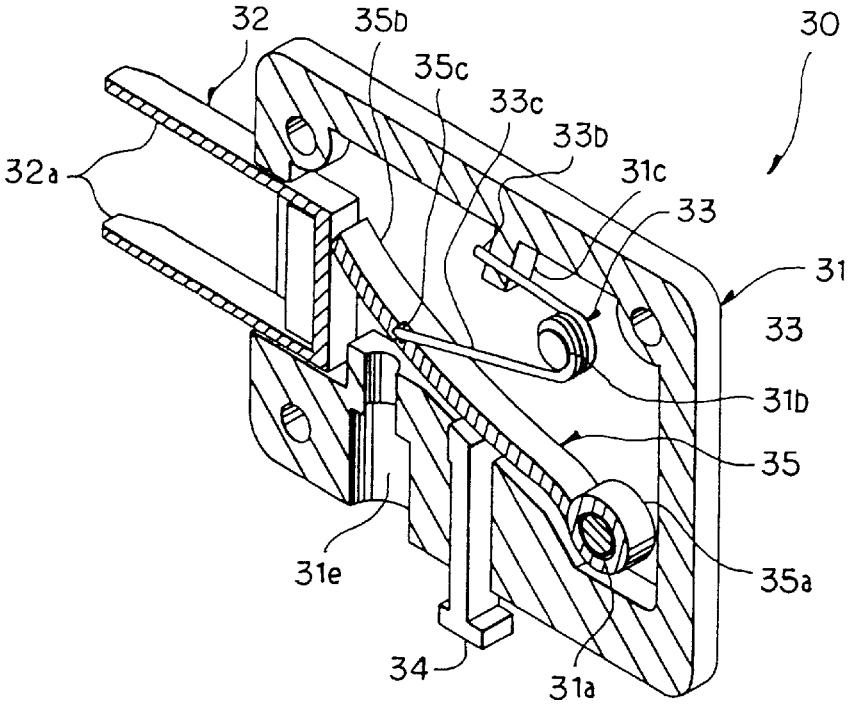
Figure 11:
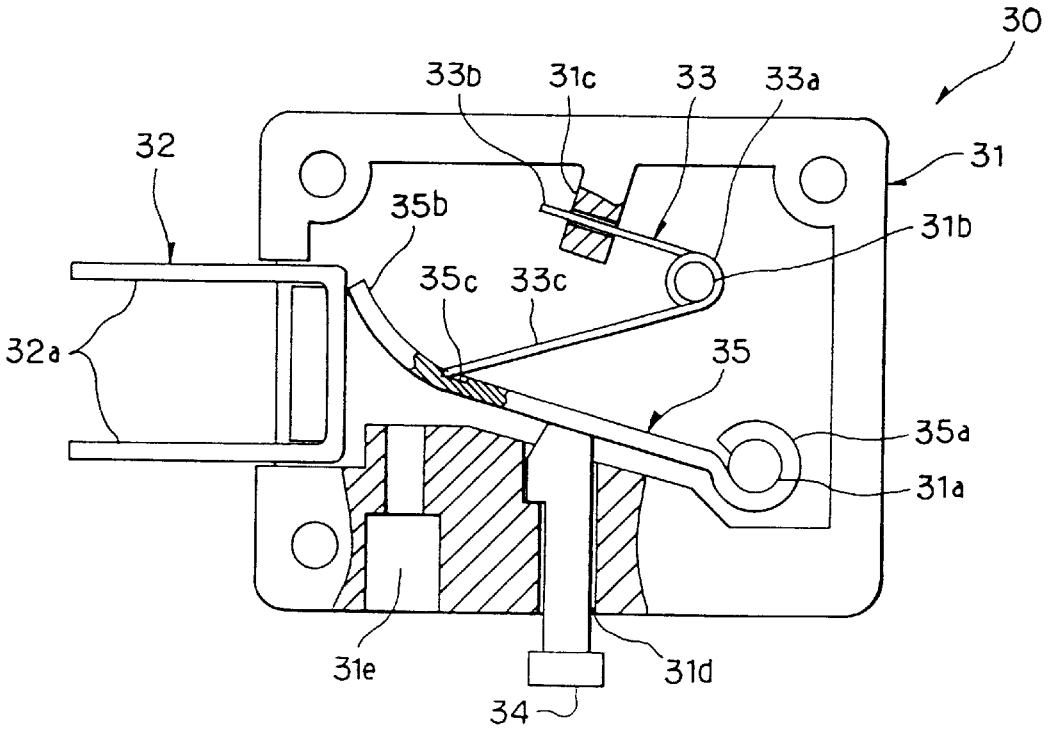

In reference to FIGS. 10 and 11 showing a second embodiment of the invention, a terminal structure 30 is composed of a case 31 of a material such as the synthetic resin and the like, which is electrically isolated and a metal terminal 32 bent into a sidewise U-shape having a pair of spaced extensions 32*a*. The metal terminal 32 is secured to the case 31 with the spaced extensions 32*a* protruded from the case 31.

The case 31 has a pin 31*a* and another pin 31*b* provided thereon at the positions respectively laterally spaced from the metal terminal 32. Further the case 31 has an abutment 31*c* formed thereon for engaging one end 33*b* of a torsion coil spring 33 and has a hole 31*d* and another hole 31*e* formed thereon. The hole 31*d* is provided to have an operating pin 34 to be inserted therethrough so that the operating pin 34 may be slidably movable therein, and the hole 31*e* is provided to have an electrically conductive wire 36 to be inserted therethrough.

A metal plate 35 has a ring 35*a* formed at one end thereof and has a flat part slightly curved and extended from the ring 35*a* to form a pressing part 35*b*. The flat part of the metal plate 35 has a recess 35*c* formed thereon for engaging the other end 33*c* of the torsion coil spring 33. The ring 35*a* of the metal plate 35 is turnably mounted on the pin 31*a* of the case 31 so that the pressing part 35*b* may be pressed against the metal terminal 32.

The torsion coil spring 33 has a coil portion 33*a* turnably mounted on the pin 31*b* of the case 31, and has one end 33*b* engaging the abutment 31*c* of the case 31 and the other end 33*c* engaging the recess 35*c* of the metal plate 35, so that the metal plate 35 may be normally pressed against the metal terminal 32.

Figure 7:
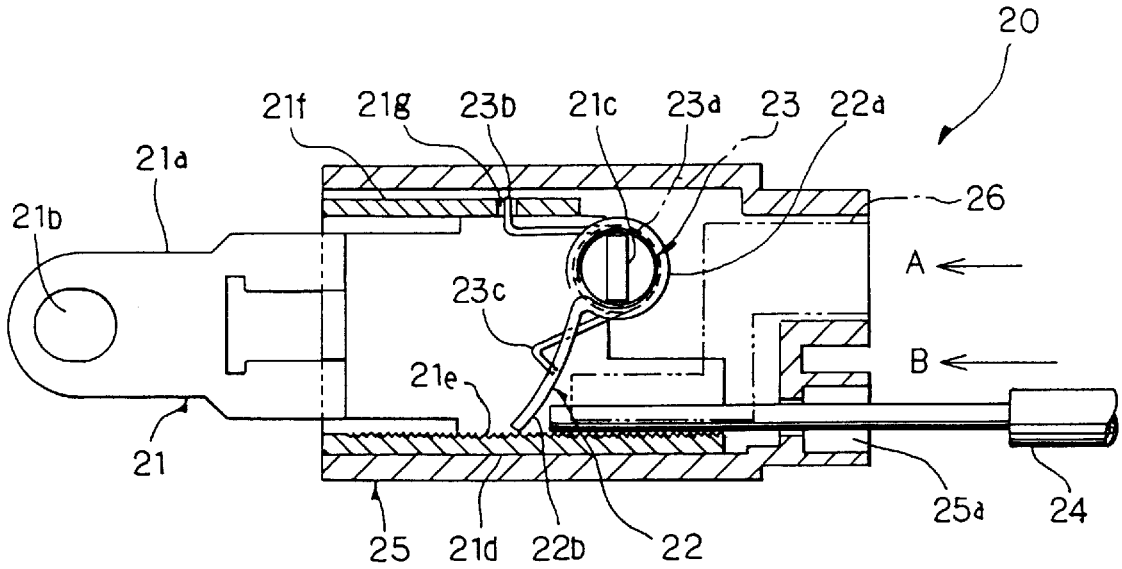
Figure 8:
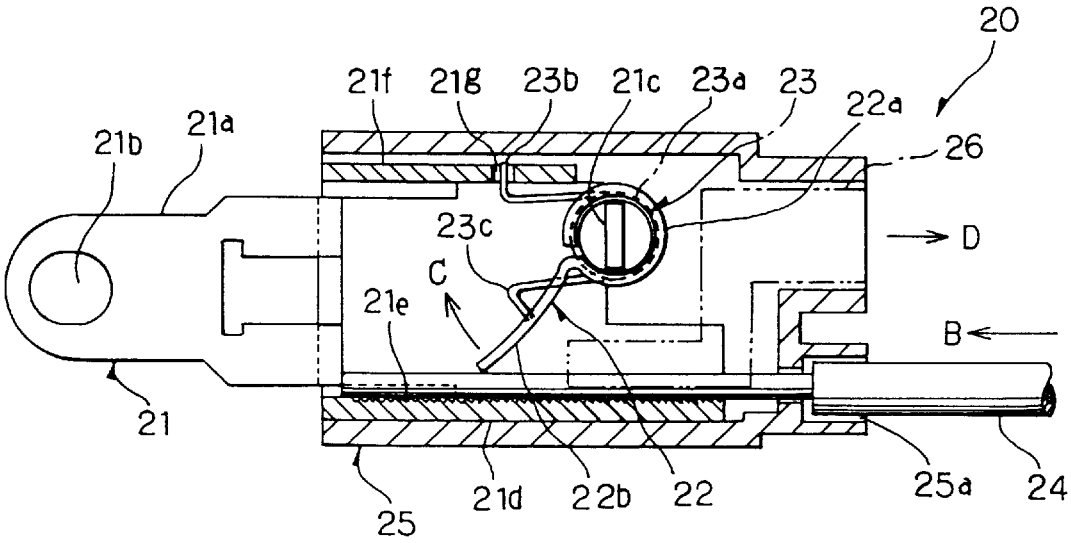
Figure 9:
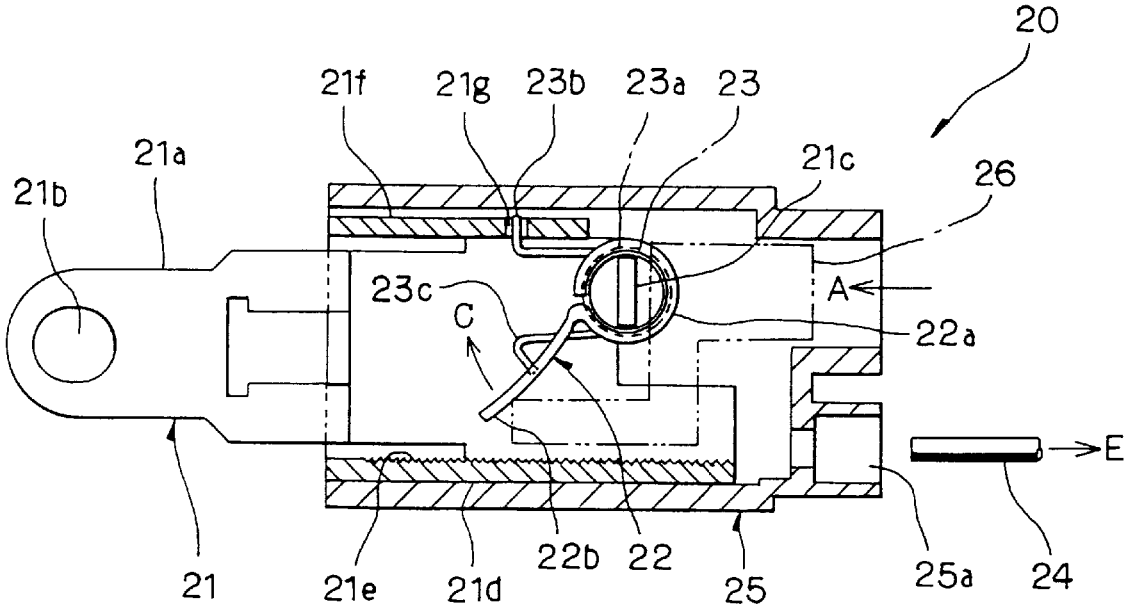

The present invention is structured as mentioned above and operates in the following manner. In reference to FIGS. 7 through 9, showing the first embodiment of the invention, in order to connect the electrically conductive wire 24 to the terminal structure 20, the electrically conductive wire 24 is inserted into the hole 25*a* of the case 25 while the operating pin 26 is pressed in the direction as indicated by the arrow A.

With the pressing operation of the operating pin 26, the metal plate 22 is, turned around the support pin 21*c* in the direction as indicated by the arrow C against the spring action of the torsion coil spring 23. The metal plate 22 is therefore moved away from the contact surface 21*e* of the metal terminal 21 while the electrically conductive wire 24 is inserted deep into the case 25.

Subsequently, when the operating pin 26 is freed, the metal plate 22 is turned by the spring action of the torsion spring 23 in the direction opposite to the direction indicated by the arrow C. Thus, the metal plate 22 will press the electrically conductive wire 24 against the contact surface 21*e* of the metal terminal 21, thereby to establish an electrically conductive relation between the metal terminal 21 and the electrically conductive wire 24. Simultaneously, the operating pin 26 is returned in the direction as indicated by the arrow D to the initial inoperative position by the action of the spring action of the torsion coil spring 23.

In order to remove the electrically conductive wire 24 from the terminal structure 20, the operating pin 26 is, as shown in FIG. 9, is again pressed in the direction as indicated by the arrow A, thereby to turn the metal plate 22 around the support pin 21*c* in the direction as indicated by the arrow C against the spring action of the torsion spring 23. In the meantime, the electrically conductive wire 24 may be pulled out of the terminal structure 20 in the direction as indicated by the arrow E with an extremely light operation force of the operating pin 26. Actually, in contrast to the plate spring, the torsion coil spring may, due to the property thereof, be initially set to have a small spring force. Precisely, concerning the torsion coil spring, the increasing amount of spring force (spring constant) per unit deformation amount may be set to a considerably small value compared with the plate spring.

Figure 12:
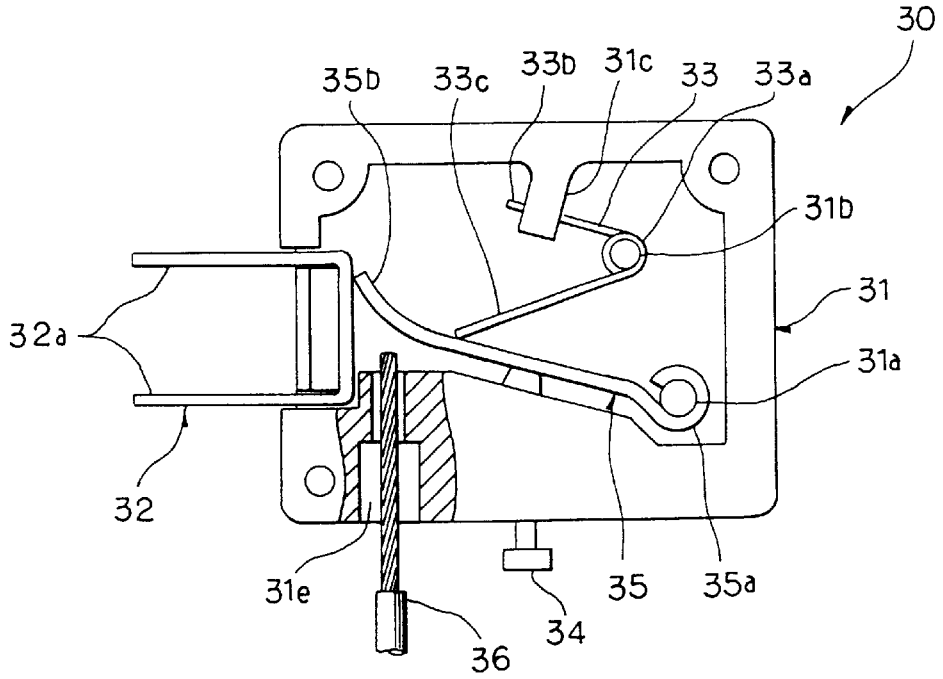
Figure 13:
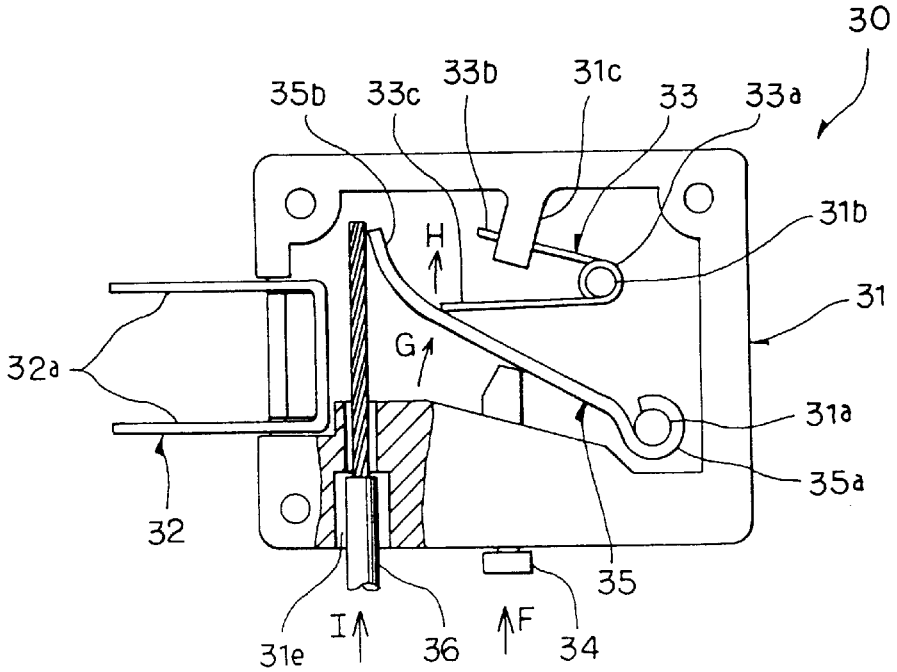
Figure 14:
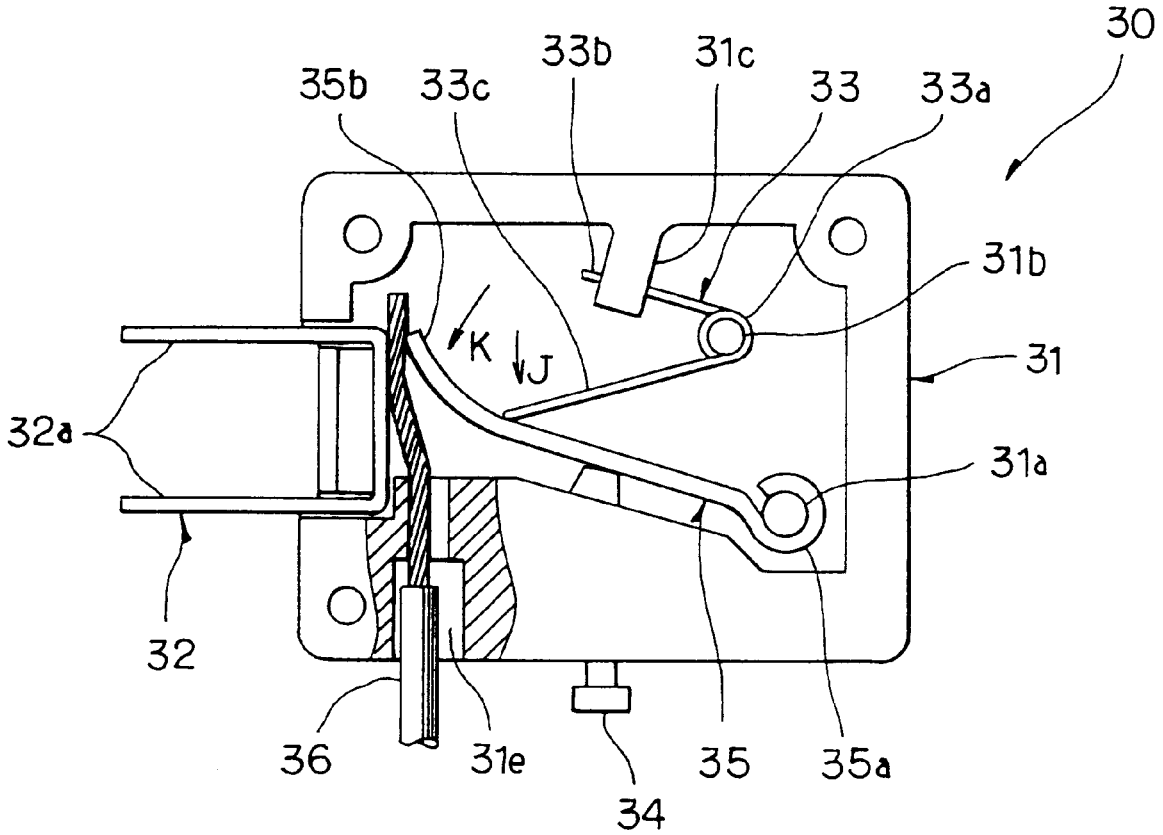
Figure 15:
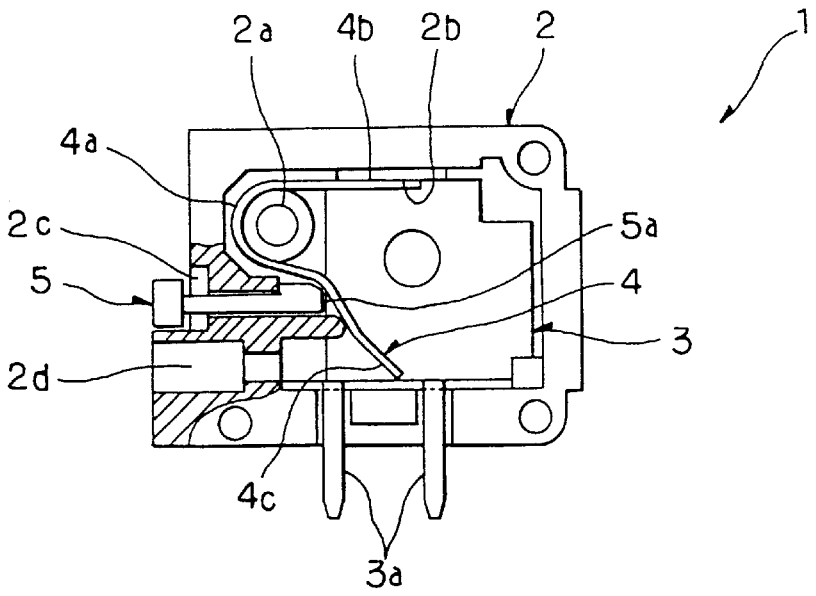
Fig. 15 (Prior Art)
Figure 16:
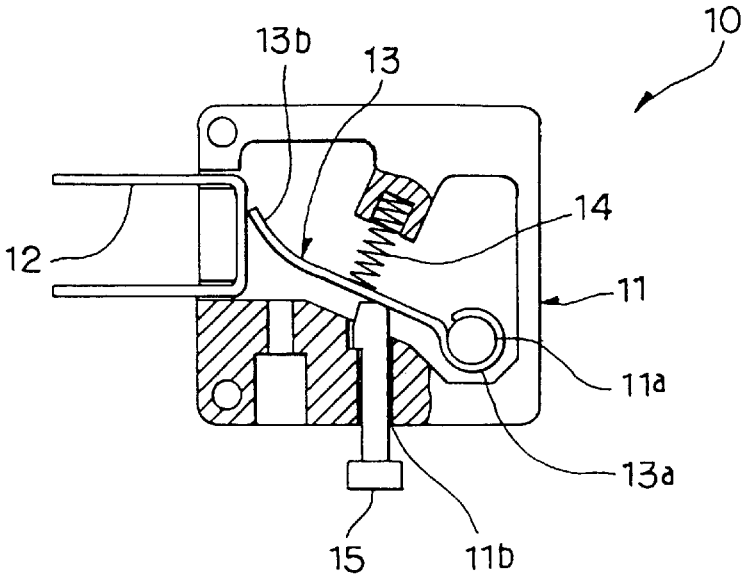
Fig. 16 (Prior Art)

Similarly with respect to the second embodiment of the invention, particularly in reference to FIGS. 12 through 14, in order to connect the electrically conductive wire 36 to the terminal structure 30, the operating pin 34 is pressed in the direction as indicated by the arrow F, thereby to turn the metal plate 35 around the support pin 31*a* away from the metal terminal 32 in the direction, as indicated by the arrow G, against the spring action especially of the end 33*c* of the torsion coil spring 33 while the electrically conductive wire 36 is inserted deep into the terminal structure 30 in the direction as indicated by the arrow I through the hole 31*e*. Subsequently, when the operating pin 34 is freed, the end 33*c* of the torsion coil spring 33 is recovered in the direction as indicated by the arrow J, thereby to turn the metal plate 35 in the direction as indicated by the arrow K. Thus the metal plate 35 presses the electrically conductive wire 36 against the metal terminal 32 thereby to establish the electrically conductive relation between the terminal structure 30 and the electrically conductive wire 36.

In order to remove the electrically conductive wire 36 from the terminal structure 30, the operating pin 34 is pressed again in the direction as indicated by the arrow F, in the same manner as the first embodiment, thereby to turn the metal plate 35 away from the metal terminal 32 while the electrically conductive wire 36 is pulled out of the terminal structure 30.

What is claimed is:

1. A terminal structure for detachably holding an electrically conductive wire for electrical conduction therewith, said terminal structure comprising:

a case;

a metal terminal provided in said case;

a metal plate provided in said case and having one end rotatably supported on said case so that an opposite end of said metal plate may be moved toward and away from said metal terminal; and a torsion coil spring having opposite ends extending from a coil portion rotatably supported on said case, one of the opposite ends of the torsion coil spring being pressed against said case and the other of the opposite ends of the torsion coil spring being urged against said metal plate thereby to press said opposite end of said metal plate against said metal terminal, said coil portion of said torsion coil spring being accommodated by said one end of said metal plate; and an operating member pressable into said case in opposition to spring action of said torsion coil spring to press said opposite end of said metal plate against said metal terminal, to rotate said opposite end of said metal plate away from said metal terminal to allow an electrically conductive wire to be inserted between said metal plate and said metal terminal substantially in the direction in which said opposite end of said metal plate is rotated away from said metal terminal, said opposite end of said metal plate being urged to increase a force thereof for pressing said electrically conductive wire against said metal terminal when said electrically conductive wire is pulled.

2. The terminal structure as defined in claim 1, wherein said case has a wall and a support extending laterally of the wall, said torsion coil spring and said metal plate being coaxially supported on said support.

3. The terminal structure as defined in claim 1, wherein said case has a wall and a first support extending laterally of the wall and a second support extending laterally of said wall in parallel with said first support, said metal plate being supported on said first support and said torsion coil spring being supported on said second support.

* * * * *